US005937797A

United States Patent [19]

Ban et al.

[11] Patent Number: 5,937,797

[45] Date of Patent: Aug. 17, 1999

[54] VISCOUS FLUID HEATER

[75] Inventors: Takashi Ban; Takanori Okabe, both of Kariya, Japan

[73] Assignee: Kabushiki Kaisha Toyoda Jidoshokki Seisakusho, Kariya, Japan

[21] Appl. No.: 08/893,879

[22] Filed: Jul. 11, 1997

[30] Foreign Application Priority Data

Jul. 15, 1996 [JP] Japan ..... 8-184925

[51] Int. Cl.[6] ..... F22B 3/06

[52] U.S. Cl. ..... 122/26; 126/247

[58] Field of Search ..... 122/26, 247; 237/12.3 R, 237/1 R

[56] References Cited

U.S. PATENT DOCUMENTS

| | | | |
|---|---|---|---|
| 4,143,639 | 3/1979 | Frenette | 122/26 |
| 4,343,291 | 8/1982 | Clausen | 126/247 |
| 4,365,614 | 12/1982 | Grover | 126/247 |
| 4,481,934 | 11/1984 | Stephenson | 126/247 |
| 4,494,524 | 1/1985 | Wagner | 126/247 |
| 4,501,231 | 2/1985 | Perkins | 122/26 |
| 4,779,575 | 10/1988 | Perkins | 122/26 |
| 5,341,768 | 8/1994 | Pope | 126/26 |
| 5,704,320 | 1/1998 | Ban et al. | 122/26 |

FOREIGN PATENT DOCUMENTS

| | | |
|---|---|---|
| 0361053 | 4/1990 | European Pat. Off. . |
| 0771682 | 5/1997 | European Pat. Off. . |
| 19521029 | 12/1996 | Germany . |
| 9633374 | 10/1996 | WIPO . |

*Primary Examiner*—Philip H. Leung
*Assistant Examiner*—Jiping Lu
*Attorney, Agent, or Firm*—Morgan & Finnegan, L.L.P.

[57] ABSTRACT

A viscous fluid heater includes a housing for accommodating a heating chamber and a heat exchanging chamber. Viscous fluid is contained in the heating chamber, and circulating fluid circulates through the heat exchanging chamber. A cylindrical rotor is located in the heating chamber, which rotates to shear the viscous fluid in the heating chamber and thus generate heat which heats the circulating fluid in the heat exchanging chamber. The cylindrical rotor is hollow, which defines a reservoir chamber within the rotor to contain the viscous fluid. The rotor has at least one, and preferably a plurality of circumferentially spaced apart communicating passages between its interior reservoir chamber and the viscous fluid heating chamber which surrounds the rotor, so that viscous fluid flows from the reservoir chamber into the heating chamber, in which it flows outwardly to the ends of the rotor. The viscous fluid returns to the reservoir chamber via axial passages in the respective end walls of the rotor.

23 Claims, 4 Drawing Sheets

VISCOUS FLUID HEATER

BACKGROUND OF THE INVENTION

1. FIELD OF THE INVENTION

The present invention relates to viscous fluid heaters, and more particularly, to heaters having a heating chamber and a heat exchanging chamber accommodated in a housing with viscous fluid and a rotor accommodated in the heating chamber. Heat exchange takes place between the heat generated in the heater when the rotor shears the viscous fluid and a circulating fluid flowing through the heat exchanging chamber.

2. DESCRIPTION OF THE RELATED ART

Viscous fluid heaters, which are operated by the drive force of automobile engines, have become widely used as an auxiliary heat source. Japanese Unexamined Patent Publication No. 2-246823 describes a typical viscous fluid heater incorporated in a vehicle heating apparatus.

The viscous fluid heater has a front housing and a rear housing which are coupled to each other. A heating chamber is defined in the front and rear housings while a water jacket (heat exchanging chamber) encompasses the heating chamber. A drive shaft is rotatably supported by a bearing in the front housing. A rotor is fixed to one end of the drive shaft in the heating chamber. Thus, the rotor and the drive shaft rotate integrally. Rib-like projections are provided on the front and rear surfaces of the rotor and the opposed inner walls of the heating chamber. The opposed projections are aligned with one another so as to form labyrinth grooves. Furthermore, the opposing projections are spaced from each other so as to form a labyrinth-like clearance between the outer surfaces of the rotor and the inner walls of the heating chamber. A predetermined amount of a viscous fluid, such as silicone oil, is contained in the heating chamber. The viscous fluid also fills the labyrinth-like clearance.

When the drive force of the engine is transmitted to the drive shaft, the drive shaft rotates together with the rotor in the heating chamber. The viscous fluid between the inner walls of the heating chamber and the outer surfaces of the rotor are sheared by the rotation of the rotor. This results in fluid friction and produces heat. Heat exchange occurs between the heating chamber and the coolant circulating through the water jacket. The heated coolant is then sent to an external heater circuit to warm the passenger compartment.

The prior art viscous fluid heater described above requires the rib-like projections to be formed on the front and rear surfaces of the rotor to form the labyrinth grooves. Accordingly, a rotor body is disk-like and the axial length of the body is shorter than the radius of the body. In such a rotor, the main shearing surface corresponds to the rib-like surfaces provided on the front and rear surfaces of the rotor. Furthermore, the rotating speed (i.e., shearing speed) of the rib-like projections becomes higher at positions located farther from the axis of the rotor body. Thus, it is necessary to enlarge the rotor diameter, that is, the outer diameter of the rotor body, to increase the heating value of the heater. However, space, and especially, space in the engine compartment, is limited. Thus, if the radius of the viscous fluid heater is large, it is difficult to provide sufficient space for the heater in the engine compartment. Furthermore, a large viscous fluid heater affects the layout of other equipment in the vehicle.

SUMMARY OF THE INVENTION

Accordingly, it is an objective of the present invention to provide a viscous fluid heater that maintains constant heating value and facilitates installation in vehicles or the like.

It is a further objective of the present invention to provide a viscous fluid heater that has a superior heating ability and that copes with the problems caused when altering the basic shape (or dimension) of the rotor and the heater body.

To achieve the above objective, the present invention provides a viscous fluid heater including a housing for accommodating a heating chamber and a heat exchanging chamber. Viscous fluid is contained in the heating chamber. Circulating fluid circulates through the heat exchanging chamber. A rotor is located in the heating chamber. The rotor rotates to shear the viscous fluid in the heating chamber and thus generate heat. The circulating fluid exchanges heat with the heated viscous fluid in the heating chamber. A reservoir chamber is defined within the rotor to reserve the viscous fluid.

Other aspects and advantages of the invention will become apparent from the following description, taken in conjunction with the accompanying drawings, illustrating by way of example the principals of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
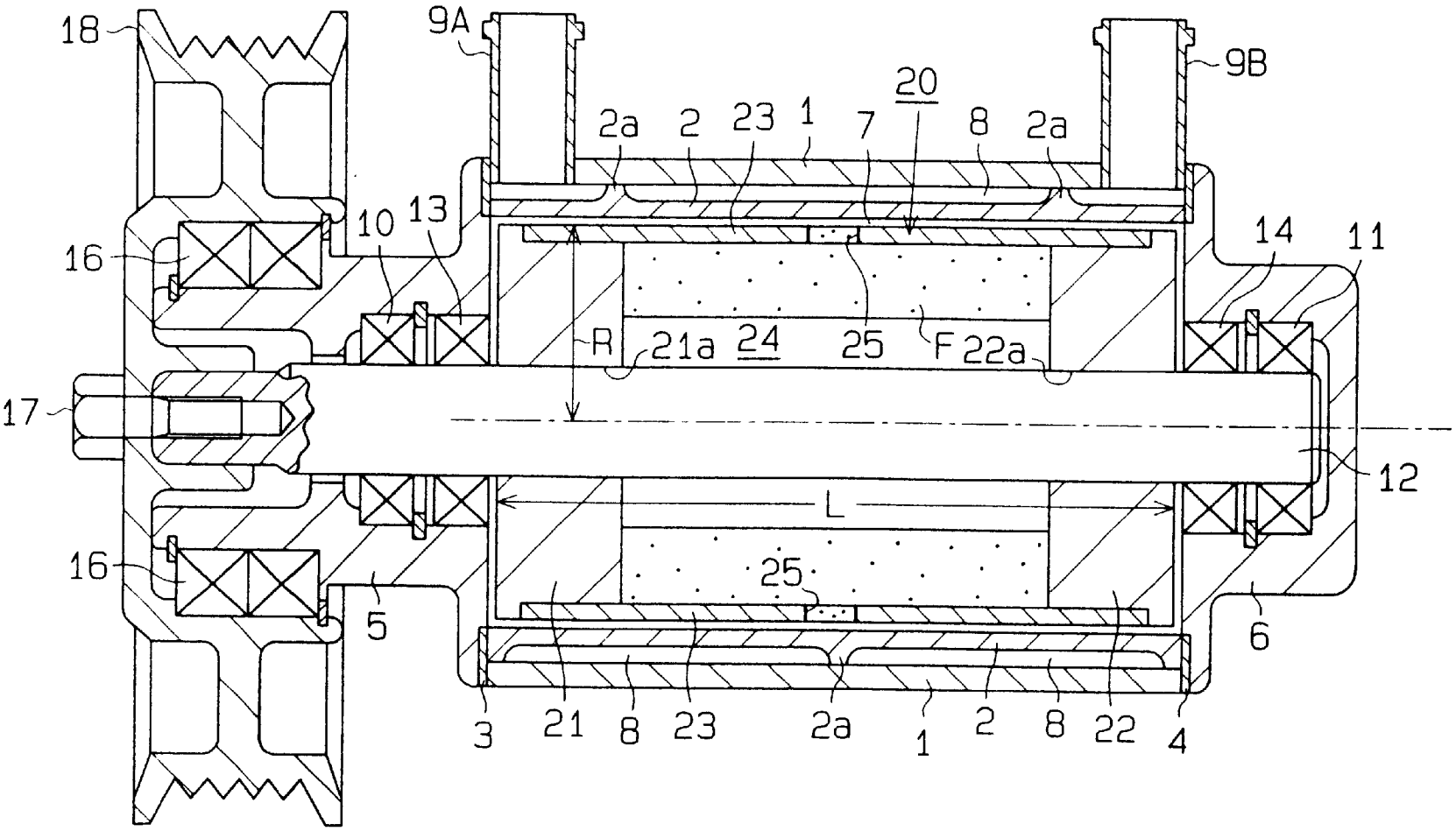
FIG. 1 is a cross-sectional view showing a viscous fluid heater according to a first embodiment of the present invention.

A viscous fluid heater, which is incorporated in a vehicle heating apparatus, according to a first embodiment of the present invention will now be described with reference to FIG. 1. As shown in FIG. 1, the viscous fluid heater of the first embodiment has a housing that is constituted by a cylindrical intermediate housing 1, a cylinder block 2, a front housing 5, and a rear housing 6. The housing is fixed on an engine (not shown) of the vehicle.

The cylinder block 2, which is substantially cylindrical, is pressed into the intermediate housing 1. A rib 2*a* extends helically along the peripheral surface of the cylinder block 2. The front ends of the intermediate housing 1 and the cylinder block 2 are coupled to the front housing 5 with a gasket 3 arranged in between. The rear ends of the intermediate housing 1 and the cylinder block 2 are coupled to the rear housing 6 with a gasket 4 arranged in between. A heating chamber 7 is defined in the hollow cylinder block 2. Accordingly, the cylinder block 2, the front housing 5, and the rear housing 6 constitute a partitioning member, which defines the heating chamber 7 in the housing.

When the cylinder block 2 is pressed into the intermediate housing 1, the helical rib 2*a* on the peripheral surface of the cylinder block 2 abuts against the cylindrical inner wall of the intermediate housing 1. A water jacket 8, which serves as a heat exchanging chamber, is defined in the space between the peripheral surface of the cylinder block 2 and the inner surface of the intermediate housing 1.

An inlet port 9A is provided at the front of the intermediate housing 1. Coolant, which serves as a circulating fluid, circulates between a vehicle heater circuit (not shown) and the water jacket 8 through the inlet port 9A. An outlet port 9B is provided at the rear of the intermediate housing 1. The coolant is sent out from the water jacket 8 to the heater circuit through the outlet port 9B. In the water jacket 8, the rib 2*a* serves as a means for guiding the circulating fluid and provides a helical circulation passage for the circulating fluid that flows from the inlet port 9A to the outlet port 9B.

Bearings 10, 11 are provided in the front and rear housings 5, 6, respectively. The bearings 10, 11 rotatably support a drive shaft 12. An oil seal 13 is provided in the front housing 5 adjacent to the heating chamber 7. An oil seal 14 is provided in the rear housing 6 adjacent to the heating chamber 7. The middle portion of the drive shaft 12 in the heating chamber 7 is arranged between the oil seals 13, 14. Thus, the oil seals 13, 14 seal the interior space of the heating chamber 7. In the heating chamber 7, a rotor 20 is fixed to the drive shaft 12 and supported so as to rotate integrally with the shaft 12.

The rotor 20 includes a pair of fixed plates 21, 22, which are made of aluminum alloy, and a hollow cylindrical wall member 23. Openings 21*a*, 22*a* extend through the center of the fixed plates 21, 22, respectively. The drive shaft 12 is inserted through the openings 21*a*, 22*a*. The fixed plates 21, 22 are spaced with a predetermined interval therebetween in the heating chamber 7 and fixed to the drive shaft 12 so as to rotate integrally with the shaft 12. The cylindrical member 23 is attached to the fixed plates 21, 22. Thus, the rotor 20 is formed in a drum-like manner and includes a hollow reservoir chamber 24, which is sealed.

The rotor 20 has a cylindrical peripheral surface, whose axial length L is longer than its radius R, or radial length extending from the axis of the rotor 20 (coaxial with the drive shaft 12). The radius R of the rotor 20 is determined so that a slight clearance (gap) is provided between the cylindrical surface of the rotor 20 and the inner surface of the heating chamber 7 (or the inner surface of the cylinder block 2). The axial length L of the rotor 20 is determined so that a slight clearance (gap) is provided between the end surfaces of the rotor 20 (or the outer surfaces of the fixed plates 21, 22) and the associated end surfaces of the heating chamber 7 (or the inner end surfaces of the front and rear housings 5, 6). In the rotor 20, the cylindrical member 23 functions as the peripheral wall of the rotor 20, and the fixed plates 21, 22 function as the end walls of the rotor 20.

A plurality of communication holes 25 (only two shown in FIG. 1) are provided at the axially middle section of the cylindrical member 23. The communication holes 25 are arranged around the cylindrical member 23 with an equal angle between adjacent holes 25. For example, if there are two communicating holes 25, the angular interval between the two holes 25 is 180 degrees. If there are four communicating holes 25, the angular interval between adjacent holes 25 is 90 degrees. The arrangement of the communication holes 25 enables at least one hole 25 to be positioned lower than the drive shaft 12 and at least one hole 25 to be positioned higher than the drive shaft 12 regardless of where the rotation of the rotor 20 stops. Each communication hole 25 serves as a communication passage connecting the interior space of the rotor 20, or the reservoir chamber 24, with the interior space of the heating chamber 7, or the clearance. Furthermore, each communication hole 25 serves as a passage for supplying and recovering the viscous fluid. Accordingly, the reservoir chamber 24 is part of the heating chamber 7.

The heating chamber 7 contains a predetermined amount of silicone oil, which serves as the viscous fluid. Since the heating chamber 7 is communicated with the reservoir chamber 24 by the communication holes 25, the silicone oil F enters the reservoir chamber 24 through the communication holes 25 when the silicone oil F is charged into the heating chamber 7. The volume of the free space in the reservoir chamber 24 is represented as V1 while the total volume of each clearance provided between the outer surface of the rotor 20 and the inner walls of the heating chamber 7 is represented as V2. The total charging amount Vf of the silicone oil is determined so that the charging ratio of the silicone oil is within the range of 50 percent to 70 percent with respect to the total free space volume in the heating chamber 7 (V1+V2), which includes the reservoir chamber 24, under normal temperatures. FIG. 1 illustrates the silicone oil F spread against the inner wall of the reservoir chamber 24, as it would be during rotation of the rotor 20 under normal conditions.

A bearing 16 is arranged in the front housing 5 to rotatably support a pulley 18. The pulley 18 is fastened to the front end of the drive shaft 12 by a bolt 17. The pulley 18 is operably connected to a vehicle engine, which serves as an external drive source, by a transmission belt (not shown). Accordingly, the drive force of the engine rotates the drive shaft 12 by means of the pulley 18. The rotor 20 is rotated integrally with the drive shaft 12. The silicone oil F included in the clearance between the outer surface of the rotor 20 and the inner walls of the heating chamber 7 is sheared and heated by the rotation of the rotor 20. Heat exchange takes place through the cylinder block 2 between the heated silicone oil and the coolant circulating through the water jacket 8. The heated coolant is sent to the heater circuit. This warms the passenger compartment.

In this state, the heating value Q1 of the end surfaces of the rotor 20 is expressed by the following equation:

$$Q1=\pi\mu\omega^2R^4/\delta2$$

In this equation, $\mu$ represents the coefficient of viscosity, $\delta2$ represents the distance between each end surface of the rotor 20 and the associated end surface of the heating chamber 7, $\omega$ represents angular velocity, and R represents the radius of the rotor R.

The heating value Q2 of the cylindrical peripheral surface of the rotor 20 is expressed by the following equation:

$$Q2=2\pi\mu\omega^2R^3L/\delta1$$

this equation, L represents the axial length of the rotor 20 and $\delta1$ represents the distance between the peripheral surface of the rotor 20 and the inner surface of the heating chamber 7.

The condition of $\delta1<\delta2$ must be satisfied to have the peripheral surface of the rotor 20 function as the main shearing surface. Furthermore, the condition of $Q1<Q2$ is satisfied by using the rotor 20, which is characterized by the inequality R (radius)<L (axial length). This results in a large heating value Q2 being generated at the peripheral surface of the rotor 20.

The helical rib 2*a* functions as a heat conduction means, which conducts the heat transferred through the cylinder block 2 from the heating chamber 7 to the intermediate housing 1. As a result, the coolant circulating through the water jacket 8 receives the heat of both the cylinder block 2 and the intermediate housing 1. That is, the cylinder block 2 functions as an inner partitioning member of the water jacket 8, and the intermediate housing 1 functions as an outer partitioning member of the water jacket 8.

The advantageous effects of the first embodiment will now be described.

(1) When the rotation of the drive shaft 12 and the rotor 20 is stopped, the silicone oil F in the reservoir chamber 24 and the silicone oil in the clearance of the heating chamber 7 are communicated with each other through a communicating hole 25 located at a position lower than the drive shaft 12. Therefore, the liquid level of the silicone oil in the reservoir chamber 24 and the liquid level of the silicone oil in the clearance of the heating chamber 7 are substantially the same. The liquid level is set in accordance with the total charging amount Vf of the silicone oil, as described above, and is either equal to the level of the drive shaft 12 or exceeds the level of the drive shaft 12.

If the drive shaft 12 and the rotor 20 are rotated from this state, the rotor 20 shears the silicone oil in the clearance encompassing the rotor 20. Simultaneously, as shown in FIG. 1, centrifugal force causes the silicone oil F in the reservoir chamber 24 to move in a direction away from the axis of the drive shaft 12 through the communication holes 25 and into the clearance of the heating chamber 7. In other words, centrifugal force causes the silicone oil F in the reservoir chamber 24 to spread against the inner surface of the reservoir chamber 24 (the inner surface of the cylindrical member 23). In this manner, the silicone oil F in the reservoir chamber 24 is charged into the clearance between the outer surface of the rotor 20 and the inner wall of the heating chamber 7. Simultaneously, the air (gas) in the clearance enters the reservoir chamber 24. As a result, the entire clearance about the rotor 20 is substantially filled with the silicone oil without air included therein. This maintains or enhances the heating ability.

Due to the Weissenberg effect of the viscous fluid, the rotation of the drive shaft 12 causes the silicone oil to concentrate about the drive shaft 12 in the clearance provided at end regions of the rotor 20, or the outer front and rear ends of the rotor 20. Thus, the silicone oil in the peripheral region of the rotor 20, or the outer tubular surface, is drawn toward the clearance at the front and rear ends of the rotor 20. If additional silicone oil F is not supplied to the peripheral region of the rotor 20, the Weissenberg effect may cause the oil at the peripheral region to become insufficient and may thus lower the heating capability. However, in the first embodiment, silicone oil is continuously supplied to the peripheral region of the rotor 20 from the reservoir chamber 24 during rotation of the rotor 20.

In the first embodiment, silicone oil continuously fills the peripheral region regardless of the undesirable fluid movement caused by the Weissenberg effect. This maintains or enhances the heating capability of the rotor shearing.

(2) The continuous rotation of the drive shaft 12 and the rotor 20 gradually forces the silicone oil F in the reservoir chamber 24 into the clearance in the heating chamber 7. When the rotation of the drive shaft 12 and the rotor 20 stops, at least one of the communication holes 25 is located at a position lower than the drive shaft 12. When the rotation stops, the silicone oil residing in the clearance is returned to the reservoir chamber 24. Accordingly, the liquid level of the silicone oil F in the reservoir chamber 24 returns to the original liquid level when the rotation of the rotor 20 stops.

(3) The structure by which the silicone oil is supplied to the clearance from the reservoir chamber 24 in the rotor 20 increases the absolute amount of the silicone oil that is sheared. Since the silicone oil lasts for a relatively long time before completely deteriorating, the increased amount of the sheared silicone oil allows the time between silicone oil changes to be extended. This facilitates maintenance of the viscous fluid heater. Since silicone oil is reserved in the reservoir chamber 24, space is used efficiently. This is advantageous when manufacturing a compact viscous fluid heater.

(4) By starting and stopping the rotation of the rotor 20, the charging of the silicone oil F from the reservoir chamber 24 to the clearance and the recovering of the silicone oil F from the clearance to the reservoir chamber 24 are performed in an intermittent manner. In other words, the intermittent operation of the viscous fluid heater constantly replaces the silicone oil F that is included in the clearance. Accordingly, the silicone oil F charged into the heating chamber 7 including the reservoir chamber 24 is sheared entirely in a substantially uniform manner. In other words, all of the silicone oil F deteriorates uniformly. This allows the time between silicone oil changes to be extended. Thus, the maintenance of the viscous fluid heater is facilitated.

(5) The total charging amount Vf of the silicone oil F in the heating chamber 7 is determined so that the charging volume of the silicone oil F under normal temperatures is 70 percent or lower with respect to the total free space volume (V1+V2) in the heating chamber 7. In other words, at least 30 percent of the space in the heating chamber 7 including the reservoir chamber 24 is free. The open space functions as a relief space, which prevents excessive pressure increase when the heated silicone oil F expands. Furthermore, during rotation of the rotor 20, the open space exists mainly in the reservoir chamber 24 and does not exist in the clearance about the rotor 20. Thus, the open space in the heating chamber 7 (reservoir chamber 24) does not decrease the heating capability.

The heating chamber 7 is sealed in an air-tight manner. Thus, the moisture in the atmosphere does not affect the silicone oil F. This avoids an early deterioration of the silicone oil F.

A viscous fluid heater according to a second embodiment of the present invention will now be described with reference to FIG. 2. To avoid a redundant description, like or same reference numerals are given to those components that are like or the same as the corresponding components of the first embodiment. The structure of the viscous fluid heater of the second embodiment is basically the same as that of the first embodiment (FIG. 1) except for the structure of the rotor. Thus, the rotor 30 will mainly be described below.

Figure 2:
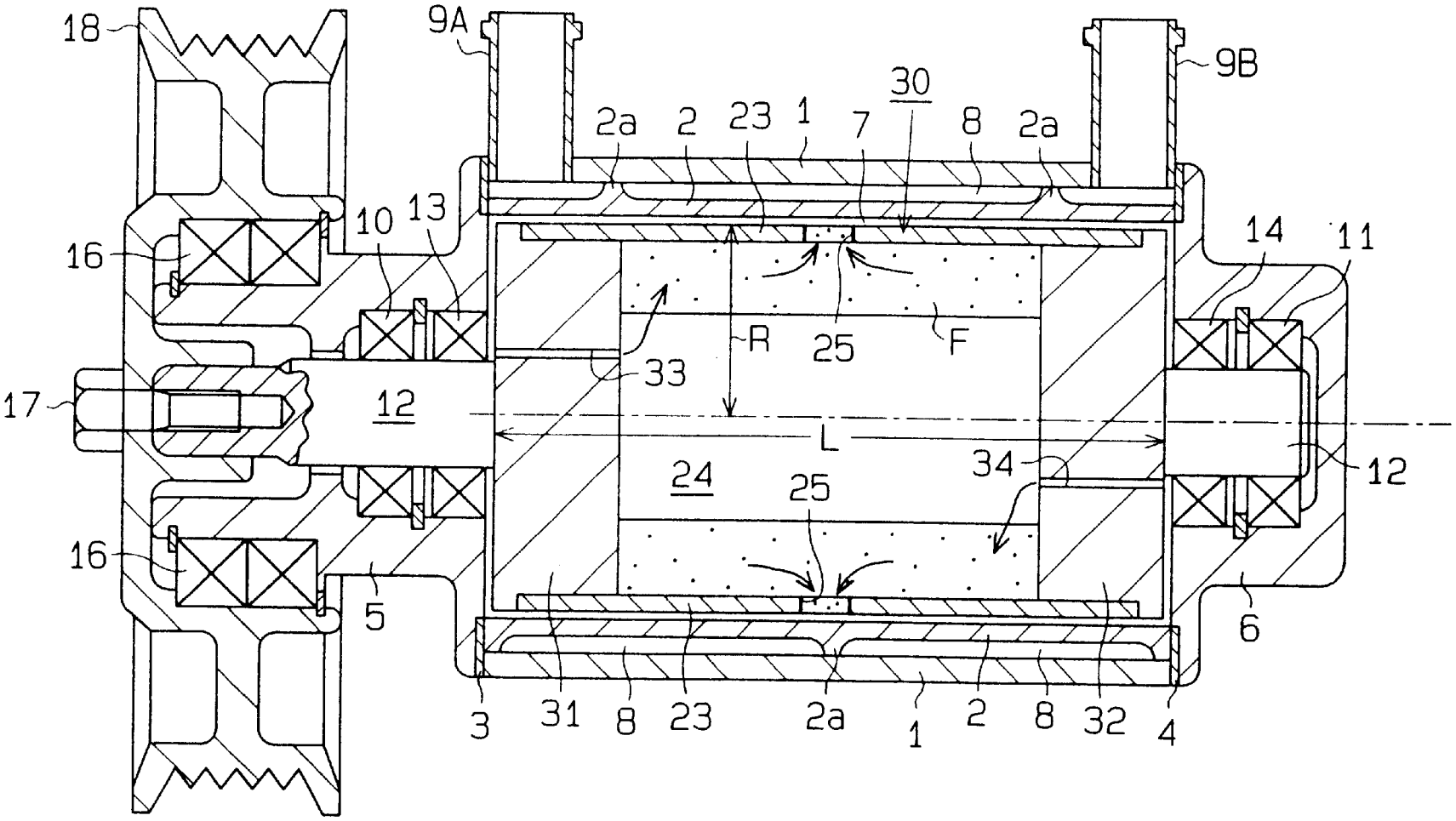
FIG. 2 is a cross-sectional view showing a viscous fluid heater according to a second embodiment of the present invention.

As shown in FIG. 2, the drive shaft 12 is made of two parts, a front shaft piece and a rear shaft piece. The rotor 30 is secured to each piece of the drive shaft 12 and supported so that the rotor 30 rotates integrally with the drive shaft 12. The rotor 30 includes a pair of fixed plates 31, 32 and a cylindrical member 23. The fixed plates 31, 32 are secured to the cylindrical member 23. Thus, the rotor 30 is drum-like and the has a hollow space, which defines a reservoir chamber 24.

The rotor 30 has a cylindrical peripheral surface, the axial length L of which is longer than its radius R. The rotor 30 is coaxial with the drive shaft 12. The radius R and the axial length L of the rotor 30 are determined in the same manner as in the first embodiment. A plurality of communication holes 25 (only two shown in FIG. 2) are provided at the axially middle section of the cylindrical member 23. In the same manner as the first embodiment, the communication holes 25 are arranged in the circumferential direction with equal angular intervals between one another.

Communication passages 33, 34 extend through the fixed plates 31, 32, respectively, near the drive shaft 12 (i.e., near the axis of the rotor 30). The communication passage 33 functions as a passage connecting the reservoir chamber 24 with the clearance at the front end of the fixed plate 31 and as a passage for recovering the viscous fluid. In the same manner, the communication passage 34 functions as a passage connecting the reservoir chamber 24 with the clearance at the rear end of the fixed plate 32 and as a passage for recovering the viscous fluid. The cross-sectional area (transitional area) of each communication passage 33, 34 is smaller than that of the communication holes 25.

In addition to the advantageous effects of the first embodiment, the following effects may also be obtained by this embodiment. During rotation of the rotor 30, the Weissenberg effect causes the silicone oil F to concentrate about the drive shaft 12 at the front and rear end of the rotor 30. However, the silicone oil F that concentrates about the drive shaft 12 returns to the reservoir chamber 24 through the communication passages 33, 34. Meanwhile, centrifugal force continuously forces the silicone oil F out from the reservoir chamber 24 and into the clearance about the cylindrical surface of the rotor 30. Accordingly, during rotation of the rotor 30, the silicone oil F circulates between the reservoir chamber 24 and the clearance about the rotor 30. Since the silicone oil F does not remain in the clearance at the peripheral region of the rotor 30, the oil does not deteriorate in a sudden manner. In other words, all of the silicone oil F charged into the heating chamber 7 is uniformly sheared. Thus, the silicone oil F deteriorates in a gradual manner. This extends the time between silicone oil changes.

A viscous fluid heater according to a third embodiment of the present invention will now be described with reference to FIG. 3. To avoid a redundant description, like or same reference numerals are given to those components that are like or the same as the corresponding components of the first embodiment. The structure of the viscous fluid heater of the third embodiment is basically the same as that of the first embodiment (FIG. 1) except for the drive shaft and the structure surrounding the rotor. Thus, the drive shaft and the surrounding structure rotor will mainly be described below.

Figure 3:
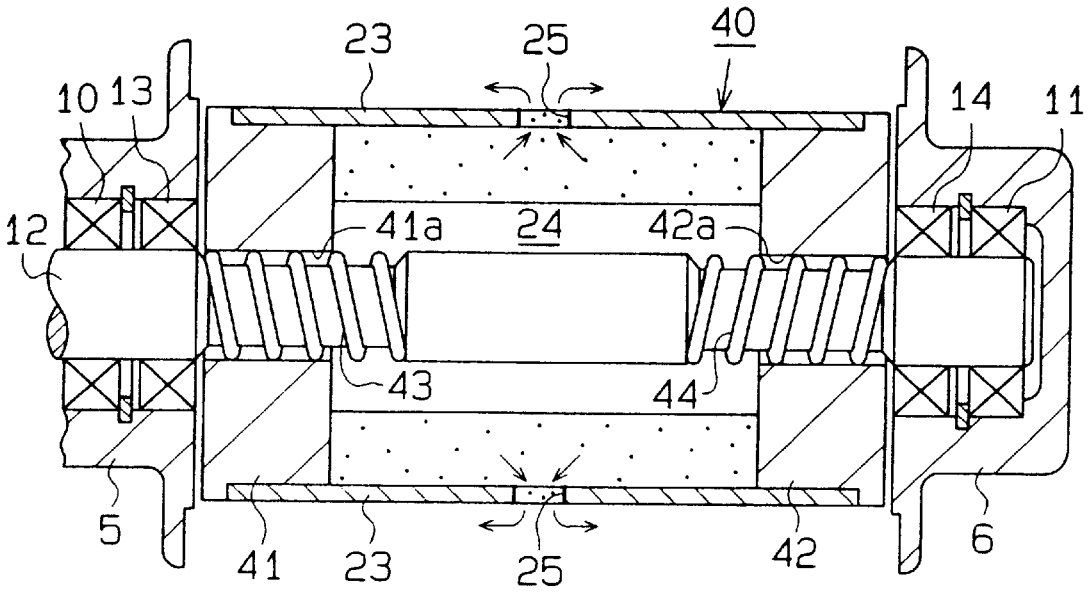
FIG. 3 is a cross-sectional view showing the main portion of a viscous fluid heater according to a third embodiment of the present invention.

As shown in FIG. 3, a pair of fixed plates 41, 42 having a predetermined space therebetween are fixed to the drive shaft 12. The fixed plates 41, 42 are provided with communication bores 41*a*, 42*a*, respectively. The communication bores 41*a*, 42*a* are coaxial with the drive shaft 12. The diameter of the communication bores 41*a*, 42*a* is set so as to cause integral rotation of the drive shaft 12 and the fixed plates 41, 42. In other words, the drive shaft 12 is tightly held by the plates 41, 42. Helical grooves 43, 44 extend along the drive shaft 12 along the communication bores 41*a*, 42*a*. The communication bores 41*a*, 42*a* and the helical grooves 43, 44 form a structure for forcibly conveying the silicone oil F. That is, the bores 41*a*, 42*a* and the grooves 43, 44 form a simple screw type pump.

During rotation of the drive shaft 12 and the rotor 40, the helical grooves 43, 44 forcibly send the silicone oil F, which collects about the drive shaft 12 in the end regions of the clearance due to the Weissenberg effect, into the reservoir chamber 24. In other words, the screw type pump constitutes a device for forcibly recovering the viscous fluid. Accordingly, centrifugal force forcibly discharges the silicone oil F that passes through the communication holes 24 from the reservoir chamber 24 and forcibly circulates the silicone oil F in the heating chamber 7.

The screw type pump also functions to forcibly supply the silicone oil F to the outer end of the fixed plates 41, 42 from the reservoir chamber 24 by reversing the rotation of the drive shaft 12.

Although only three embodiments of the present invention have been described so far, it should be apparent to those skilled in the art that the present invention may be embodied in many other specific forms without departing from the spirit or scope of the invention. Particularly, it should be understood that the present invention may be embodied in the following forms.

Figure 4:
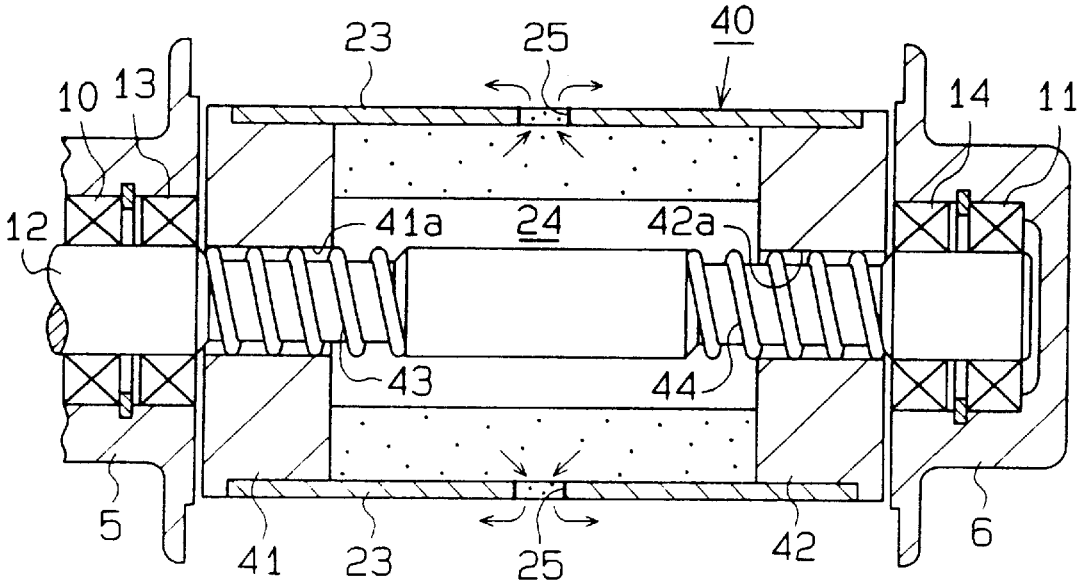
FIG. 4 is a cross-sectional view showing the main portion of a viscous fluid heater according to a fourth embodiment of the present invention.

(a) In the embodiment of FIG. 3, the helical grooves 43, 44 extend in opposite directions along the drive shaft 12. However, as shown in FIG. 4, the helical grooves 43, 44 may be formed so that they extend in the same direction along the drive shaft 12. In this case, in accordance with the rotating direction of the drive shaft 12, either one of the front helical groove 43 or the rear helical groove 44 functions as the means for forcibly recovering the viscous fluid while the other functions as the means for forcibly charging the viscous fluid.

(b) In the embodiments of FIGS. 1 and 2, an electromagnetic clutch may be employed to selectively connect and disconnect the engine to the pulley 18 and the drive shaft 12 for the transmission of the engine drive force.

Figure 5:
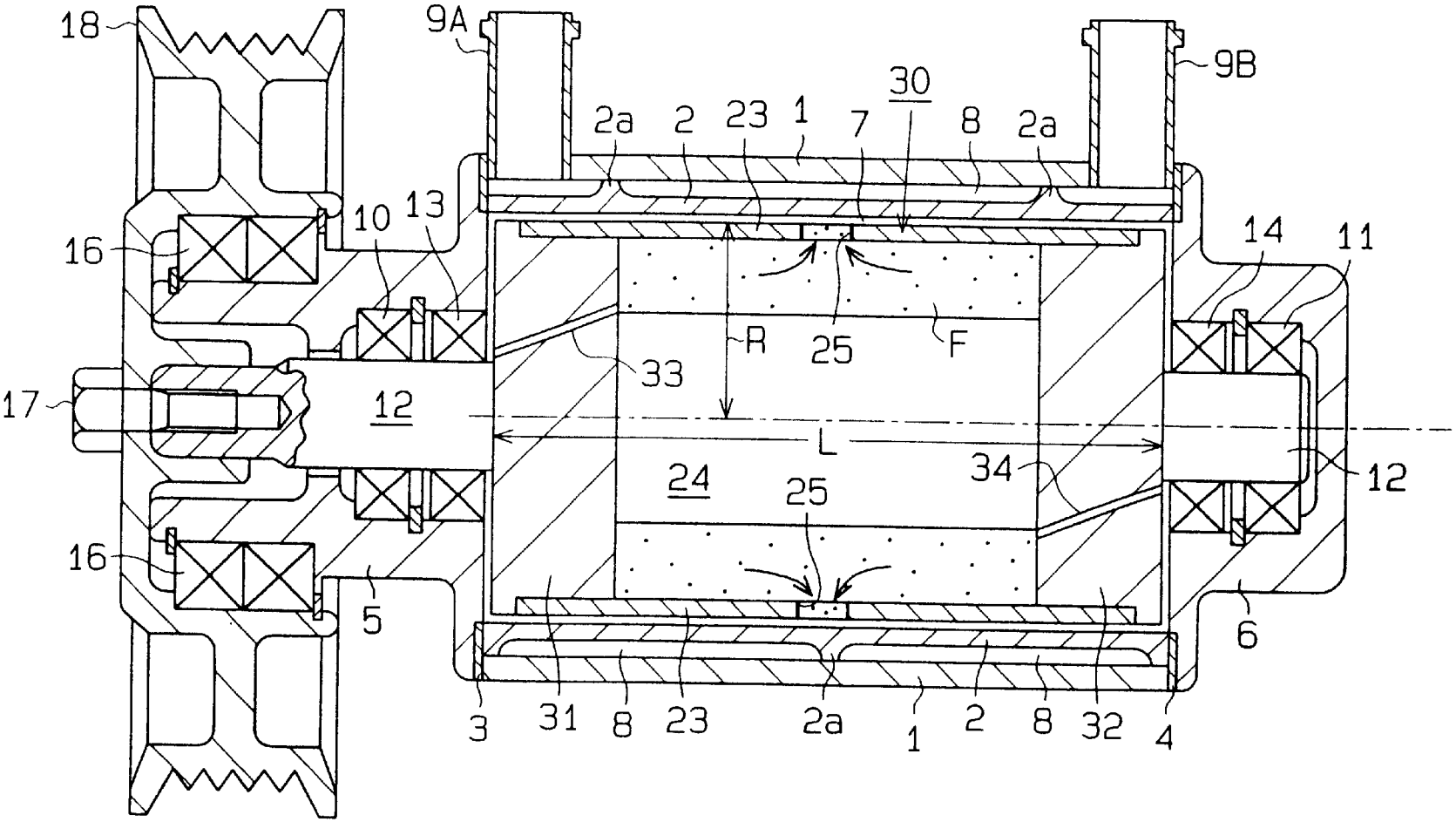
FIG. 5 is a cross-sectional view showing the main portion of a viscous fluid heater according to a fifth embodiment of the present invention.

(c) In the embodiment of FIG. 2, the communication passages 33, 34 extend axially and connect the front and rear end of the rotor 30 with the reservoir chamber 24. However, as shown in FIG. 5, each communication passage 33, 34 may extend diagonally from the vicinity of the drive shaft 12 at the end region of the clearance toward the peripheral portion in the reservoir chamber 24. This structure returns the silicone oil F that gathers about the drive shaft 12 to the reservoir chamber 24 through the communication passages 33, 34 by utilizing both the Weissenberg effect and the centrifugal force. In other words, this structure enhances the flow of the silicone oil F and facilitates the forcible circulation of the oil F in the heating chamber 7. In this case, the communication passages 33, 34 also serve as means for forcibly conveying and recovering the viscous fluid.

In the above description, viscous fluid refers to a medium which produces heat when sheared by the rotor. Accordingly, the viscous fluid is not limited to a liquid or semi-fluid having high viscosity such as silicone oil.

Therefore, the present examples and embodiments are to be considered as illustrative and not restrictive and the invention is not to be limited to the details given herein, but may be modified within the scope of the appended claims.

What is claimed is:

1. A viscous heater comprising:

a housing accommodating a heating chamber for containing viscous fluid and a heat exchanging chamber for circulating fluid therethrough;

a rotor located in said heating chamber, wherein said rotor rotates to shear the viscous fluid in the heating chamber and thus generate heat, and wherein said circulating fluid in the heat exchanging chamber receives heat from the heated viscous fluid in the heating chamber; and a reservoir chamber defined within said rotor to hold the viscous fluid, wherein said rotor has a cylindrical wall having an outer surface and said heating chamber has an inner surface, wherein a clearance is defined between the outer surface of the rotor and the inner surface of the heating chamber, wherein said rotor includes a communication passage extending through said cylindrical wall providing communication between the clearance and the reservoir chamber to allow passage of the viscous fluid between said reservoir chamber and said clearance, wherein said rotor includes an end wall and said heating chamber also includes and end wall facing said rotor end wall, the end wall of said rotor and the end wall of said heating chamber defining a space therebetween that forms part of the clearance, and wherein said rotor has an axial passage extending through the end wall of said rotor to allow passage of the viscous fluid between said space and said reservoir chamber.

2. The heater according to claim 1, wherein said axial passage extends through the end wall of said rotor in the vicinity of the axis of said rotor.

3. The heater according to claim 1, wherein said axial passage extends helically through the end wall of said rotor.

4. The heater according to claim 1, wherein said axial passage extends through the end wall of said rotor from the vicinity of the axis of said rotor to adjacent to the outer surface of said rotor.

5. The heater according to claim 1, wherein said communication passage has a cross-sectional area larger than the cross-sectional area of said axial passage.

6. The heater according to claim 1, wherein the heater further comprises means for forcibly conveying the viscous fluid between the clearance and the reservoir chamber.

7. The heater according to claim 6, wherein said heater further comprises a drive shaft connected to the rotor and supported so as to rotate integrally with the rotor, wherein said means for forcibly conveying includes a helical groove used as a pump to convey the viscous fluid.

8. The heater according to claim 1, wherein said heater further comprises a drive shaft connected to the rotor and supported so as to rotate integrally with the rotor, and wherein said rotor cylindrical wall outer surface has axial length which is longer than the radius of said cylindrical outer surface.

9. The heater according to claim 8, wherein said heat exchanging chamber encompasses the cylindrical outer surface of said rotor.

10. The heater according to claim 1, wherein said heat exchanging chamber includes a helical passage defined therein for directing flow of the circulating fluid.

11. A viscous fluid heater comprising:

a fixed housing accommodating a heating chamber for containing viscous fluid and a heat exchanging chamber for circulating fluid therethrough, said heating chamber having a cylindrical inner wall;

a drive shaft rotatably supported within said housing;

a rotor having a cylindrical outer wall, the rotor being coupled to said drive shaft within the heating chamber so as to be rotated integrally with said drive shaft;

a clearance defined between the cylindrical outer wall of said rotor and the cylindrical inner wall of said heating chamber, wherein said rotor rotates to shear the viscous fluid in the heating chamber and thus generate heat, and wherein said circulating fluid in said heat exchanging chamber receives heat from the heated viscous fluid in the heating chamber;

a reservoir chamber defined within said rotor to hold the viscous fluid; and a communicating passage extending through the cylindrical outer wall of the rotor to communicate said clearance with said reservoir chamber to allow passage of the viscous fluid between said reservoir chamber and said clearance, and wherein said rotor includes an end wall and said heating chamber also includes an end wall facing said end rotor wall, the end wall of said rotor and the end wall of said heating chamber defining a space therebetween that forms part of the clearance, and wherein an axial passage extends though the end wall of said rotor to allow passage of the viscous fluid between said space and said reservoir chamber.

12. The heater according to claim 11, wherein said axial passage extends through the end wall of said rotor in the vicinity of the axis of said rotor.

13. The heater according to claim 11, wherein said axial passage extends helically through the end wall of said rotor.

14. The heater according to claim 11, wherein said axial passage extends through the end wall of said rotor from the vicinity of the axis of said rotor to adjacent to said outer wall of said rotor.

15. The heater according to claim 11, wherein said communication passage has a cross-sectional area larger than the cross-sectional area of said axial passage.

16. The heater according to claim 11, wherein the heater further comprises means for forcibly conveying the viscous fluid between the clearance and the reservoir chamber.

17. The heater according to claim 16, wherein said means for forcibly conveying includes a helical groove used as a pump to convey the viscous fluid.

18. The heater according to claim 11, wherein the axial length of the cylindrical outer wall of said rotor being longer than the radius thereof.

19. The heater according to claim 18, wherein said heat exchanging chamber encompasses the cylindrical wall of said rotor.

20. The heater according to claim 11, wherein said heat exchanging chamber includes a helical passage defined therein for directing flow of the circulating fluid.

21. The heater according to claim 11, wherein said rotor end wall is at one end of said rotor cylindrical wall, and said rotor includes a second end wall at an opposite end of said rotor, and said heating chamber also includes a second end wall facing said rotor second end wall, the second end wall of said rotor and the second end wall of said heating chamber defining a space therebetween that forms part of the clearance, and wherein a second axial passage extends through the second end wall of said rotor to allow passage of the viscous fluid between the second said space and said reservoir chamber.

22. The heater according to claim 21, wherein said cylindrical outer wall of said rotor has at least two of said communicating passages in circumferentially spaced apart relation to each other, at least a pair of said passages being located respectively on opposite sides of said drive shaft.

23. The heater according to claim 22, wherein said rotor cylindrical outer wall has a middle section along its length between said first and second rotor end walls, and said rotor has a plurality of said communicating passages in circumferentially spaced apart and aligned relation to each other within said middle length section.

* * * * *

UNITED STATES PATENT AND TRADEMARK OFFICE

CERTIFICATE OF CORRECTION

PATENT NO. : 5,937,797

DATED : August 17, 1999

INVENTOR(S) : Takashi Ban and Takanori Okabe

It is certified that error appears in the above-identified patent and that said Letters Patent is hereby corrected as shown below:

Column 3, line 29, after "fixed" insert --end--.

Column 7, line 22, change "end" to --ends--.

Column 8, line 6 change "end" to --ends--; line 32, change "end" to --ends--.

Column10, line 33, change "being" to --is--.

Signed and Sealed this

Thirteenth Day of June, 2000

*Attest:*

*Attesting Officer*

Q. TODD DICKINSON

*Director of Patents and Trademarks*